US007278216B2

(12) United States Patent
Grace

(10) Patent No.: US 7,278,216 B2
(45) Date of Patent: Oct. 9, 2007

(54) ARCHERY BOW SIGHT

(75) Inventor: Nathaniel E. Grace, Port Huron, MI (US)

(73) Assignee: G5 Outdoors, L.L.P., Memphis, MI (US)

( * ) Notice: Subject to any disclaimer, the term of this patent is extended or adjusted under 35 U.S.C. 154(b) by 0 days.

(21) Appl. No.: 11/382,847

(22) Filed: May 11, 2006

(65) Prior Publication Data

US 2006/0254065 A1 Nov. 16, 2006

Related U.S. Application Data

(60) Provisional application No. 60/679,725, filed on May 12, 2005.

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS

| | | | | | |
|---|---|---|---|---|---|
| 2,542,501 | A | * | 2/1951 | Fredrickson | 33/265 |
| 3,696,517 | A | * | 10/1972 | Larson | 33/265 |
| 3,766,656 | A | * | 10/1973 | Westphal | 33/265 |
| 3,798,783 | A | | 3/1974 | Carella | |
| 4,309,827 | A | | 1/1982 | Larson | |
| 4,462,163 | A | * | 7/1984 | Tentler et al. | 33/265 |
| 4,543,728 | A | | 10/1985 | Kowalski | |
| 4,910,874 | A | * | 3/1990 | Busch | 33/265 |
| 4,961,265 | A | | 10/1990 | Roberts | |
| 4,982,503 | A | | 1/1991 | Land | |
| 5,201,123 | A | | 4/1993 | Booe | |
| 5,228,204 | A | * | 7/1993 | Khoshnood | 33/265 |
| 5,231,765 | A | | 8/1993 | Sherman | |
| 5,239,760 | A | * | 8/1993 | Dixon et al. | 33/267 |
| 6,418,633 | B1 | | 7/2002 | Rager | |
| 6,634,110 | B2 | | 10/2003 | Johnson | |

* cited by examiner

*Primary Examiner*—Christopher W Fulton
(74) *Attorney, Agent, or Firm*—Warner Norcross & Judd LLP

(57) ABSTRACT

A bow sight including a mechanism that moves a sight element, while maintaining the alignment of an associated sight indicia with a substantially linear axis, by way of a simple adjustment of the mechanism. The adjustment mechanism can include a substantially curvilinear portion and an optional substantially linear portion, and associated projections guided by the curvilinear and linear portions, that move the sight indicia along a substantially linear, vertical axis. The curvilinear and linear portions can be slots, and the projections can be guided by the slots to move the indicia along the axis. Where there are multiple sight elements, multiple, unique adjustment mechanisms maintain each associated sight indicia in alignment with the axis while providing adjustment of the spacing between sight indicia. A method for tuning the bow sight is also provided, including, moving the sight indicia along a substantially linear axis and simultaneously rotating the sight element about the sight indicia.

22 Claims, 8 Drawing Sheets

ARCHERY BOW SIGHT

This application claims benefit of U.S. provisional patent application 60/679,725, filed May 12, 2005.

BACKGROUND OF THE INVENTION

The present invention relates to archery sights, and in particular, to archery sights including sight pins that are adjustable to accommodate different shooting distances.

Most conventional archery bows are outfitted with sights that are designed to align the trajectory of an arrow shot from the bow with a target or game. These bow sights include sight pins terminating at a sight indicia—usually a fiber optic point—which must be aligned with the target for accurate shooting, Often, archers or bow hunters desire to shoot targets or game located at different distances. Accordingly, most bow sights include multiple sight pins having sight indicia aligned along a single, vertical axis or line, one over the other. Each sight indicia is calibrated for a target at a different range. Depending on the target range, the archer must select the corresponding sight pin and align its sight indicia with the target. If the archer's range estimation, pin selection and indicia alignment are correct when the archer shoots the arrow, the arrow will hit the target.

To provide a desired accuracy, a bow sight must be properly tuned. To tune a bow sight each sight pin and corresponding sight indicia must be precisely calibrated for its assigned shooting distance. In doing so, the sight indicia are usually spaced one above the other along the aforementioned common, vertical axis. The spacing between the indicia along the axis depends on the trajectory of arrows shot from the bow. For example, with greater arrow velocity, the indicia can be spaced closer to one another along the vertical axis. Further, as the target range increases, each successive sight indicia must be set at increasing, non-linear intervals along the axis to compensate for the drop of the arrow at those extended ranges.

Bow sight manufacturers usually incorporate adjustment mechanisms to move sight pins to properly tune their bow sights. A popular adjustment mechanism includes a sight pin, which defines a threaded hole, that is slidably positioned in a straight, linear slot defined by the bow sight. A threaded fastener, with a head slightly larger than the slot, is screwed into the hole to clamp the slot between the fastener head and the pin to fix the sight pin and position the sight indicia at a desired position along the vertical axis.

Although this mechanism provides a way to adjust the sight indicia along the vertical axis, it suffers several shortcomings. First, a user must perform several tedious adjustments to move the sight pin. For example, the user must unscrew the fastener, grasp the pin, move the pin, then screw the fastener into the pin to fixedly position the pin. Second, the sight pins on conventional bow sights are miniscule. Therefore, it is usually difficult for individuals with large fingers or arthritic conditions to grasp and precisely move the sight pins. Third, the precision of linear movement of the sight pins within the slot is highly dependent on the steadiness of the user's hand. If the user's hand is unsteady, it can take multiple attempts to precisely position a single sight pin. Accordingly, these conventional sight pin adjustment mechanisms typically fail to provide proper positioning of the sight indicia with rapidity and a high degree of confidence.

In an effort to overcome the above tuning difficulties of popular bow sights, some manufacturers have developed alternative adjustment mechanisms. An example of such a mechanism is disclosed in U.S. Pat. No. 6,634,110 to Johnson. The Johnson mechanism includes a sight pin including a first end that rotates about a single, fixed point. Another end, at which a sight indicia is located, is movable only linearly toward and away from the fixed point. To adjust the Johnson sight pin for a specific range, an archer must rotate the sight pin about the fixed point. Because the sight indicia moves in an arc around the fixed point, the user must then perform a second adjustment to slide the indicia into alignment with the vertical axis of the bow sight.

Although the Johnson mechanism provides a new way to adjust sight pins, it adds additional, complicated mechanisms that must be carefully manipulated to tune the bow sight. Moreover, an archer must exert extra care, and have a well-trained eye, to ensure the added linear adjustment of the sight indicia properly aligns that indicia with the vertical axis.

SUMMARY OF THE INVENTION

The aforementioned problems are overcome by a bow sight including a mechanism that moves a substantially horizontal sight element, while maintaining alignment of an associated sight indicia with an axis, by way of a simple adjustment of the mechanism.

In one embodiment, the bow sight includes multiple sight elements, corresponding sight indicia and corresponding adjustment mechanisms. Each mechanism moves its respective sight indicia along a common axis to adjust the spacing intervals between the sight indicia. Optionally, the axis is substantially vertical and linear.

In another embodiment, the bow sight adjustment mechanism includes a guide which moves and rotates an associated sight element so as to maintain the sight indicia in alignment with the linear, vertical axis of the bow sight. Optionally, the guide includes a substantially curvilinear portion and a substantially linear portion that cooperate to provide this movement and rotation of the sight element. Where there are multiple sight elements, the guide maintains each sight indicia in alignment with the axis while providing adjustment of the intervals between sight indicia.

In a further embodiment, the curvilinear portion of the adjustment mechanism guide can include a curvilinear slot or channel or recess defined in a body of the bow sight and/or adjustment mechanism plate. The sight element can include a corresponding pin or boss or other projection, which is journalled in the curvilinear slot. Optionally, the linear portion of the guide can include a linear slot, and the sight element can include another boss journalled in the linear slot. The curvilinear and linear portions of the guide can cooperate with the sight element bosses so that when the sight pin is moved, its sight indicia moves along the axis. Further optionally, the positioning of the slots and the bosses can be reversed, that is, the slots can be defined by the sight elements and the bosses included on the bow sight body or the adjustment mechanism plate.

In yet a further embodiment, where the sight indicia are desired to be moved along the axis in greater or finer increments, the design of the slots can be varied. Moreover, certain sight elements can be associated with slots of one movement increment design, while other sight pins can be associated with slots of another movement increment design. Thus, different sight elements can be moved differently along the axis on a given bow sight.

In yet another, further embodiment, the bow sight adjustment mechanism for each sight indicia can include a unique actuator. This actuator can be in the form of a rotatable adjustment screw. In operation, the adjustment screw can be rotated) which imparts linear movement to the sight element, subsequently moving the sight indicia along the axis. Optionally, the actuator imparts movement to the sight element, and the guide translates this movement so that the corresponding sight indicia moves along the vertical axis.

In addition, a method for turning a bow sight can be provided, which includes: moving a sight indicia along a substantially linear axis and simultaneously rotating the sight element about the sight indicia as the sight indicia moves.

The present invention provides a bow sight that is efficiently and easily tuned for different shooting ranges. Because the bow sight includes a single mechanism for each sight element, an archer can calibrate each sight element and corresponding sight: indicia for a specific shooting range by way of simple, rapid adjustment of that mechanism. Moreover, the archer can be confident that throughout the adjustment, the mechanism will maintain the alignment of an associated sight indicia with a vertical axis; and where multiple sight indicia are included, that all indicia remain aligned substantially along a common, vertical axis during adjustment.

These and other objects, advantages, and features of the invention will be more fully understood and appreciated by reference to the description of the current embodiments and the drawings.

DETAILED DESCRIPTION OF THE INVENTION

I. Construction and Components

Figure 1:
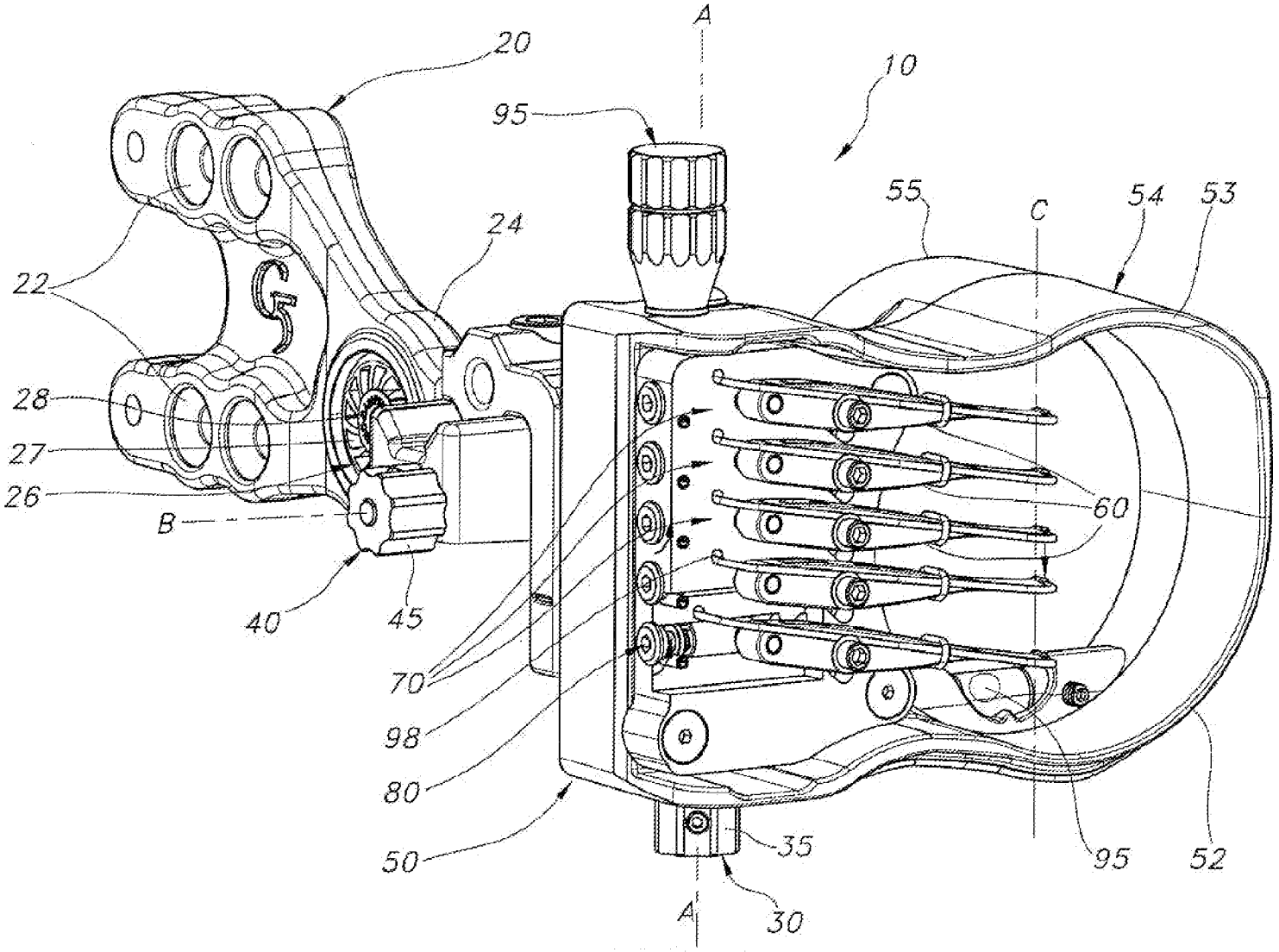
FIG. 1 is a front, perspective view of an embodiment of the bow sight.

A bow sight constructed in accordance with an embodiment of the invention is illustrated in FIGS. 1-6 and generally designated 10. The bow sight 10 generally includes a mounting bracket 20, micro adjustment mechanisms 30 and 40, a support body 50, one or more sight elements 60 and one or more associated adjustment mechanisms 70. For purposes of this disclosure, the bow sight is described in connection with its use on an archery bow, however, the assembly is well suited for use with any projectile shooting device.

With reference to the figures, the components of the bow sight will now be described. The bow sight 10 can be joined with an archery bow (not shown) via the mounting bracket 20. The mounting bracket can define bracket apertures 22 through which conventional fasteners fit to secure the bow sight to the bow. The mounting bracket can also include an arm 24 extending away from the riser of the bow (not shown), for example, extending forward of the riser.

As shown, the mounting bracket 20 can include a dampener 26 joined with the arm 24. This dampener, which can be joined with other portions of the bracket or sight, can include a material 27, for example a rubber or synthetic material, that is softer than the material from which the arm is constructed. The dampener can also include a core 28 constructed of a metal or other synthetic material. The dampener and its components can be designed to reduce vibrations in the bow sight and/or bow caused when the string of the bow is released. Other types of dampeners that are compatible with the bow sight can be used as desired, or such dampeners can be absent from the sight altogether.

The arm 24 is joined with the support body 50, however, optional micro elevation adjustment mechanism; 30 and micro windage adjustment mechanism 40 can be interposed between the arm 24 and the support body 50 to provide micro adjustment of the support body 50 relative to the bow and/or bracket 20. More specifically, the micro elevation adjustment mechanism 30 can move the support body up and down along a vertical axis A, substantially parallel to the riser of the bow. When the bow is being readied for shooting an arrow, this micro vertical axis A can be substantially vertical.

The micro elevation adjustment mechanism 30 shown includes several components, including a fastener 32, a slot 33 defined by the support body 50, a block 34, a knob 35 and associated, threaded shaft 36. The fastener 32 is threadably received by the block 34. To micro adjust the support body 50 along the vertical axis A, the fastener 32 is partially unthreaded from the block 34. The knob 35 is then turned, which rotates the threaded shaft 36. In turn, the threaded shaft threads through the block, thereby moving the support body up or down along the vertical axis A as desired. When the desired elevation is set for the support body 50, the fastener is rethreaded into the block to lock the micro adjust mechanism at a fixed location on axis A. This elevation adjust mechanism can be substituted with any other conventional elevation adjustment system as desired.

The micro windage adjustment mechanism 40 can move the support body 50, from side to side, toward and away from the riser of the bow along a micro horizontal axis B. With this mechanism, a user can micro adjust the bow sight for windage. When the bow is being readied for shooting an arrow, this micro horizontal axis B can be substantially horizontal. The micro windage adjustment mechanism shown includes several components, including a fastener 42, a slot 43 defined by the arm 24, a block 44, a knob 45 and associated, threaded shaft 46. The fastener 42 is threadably received by the block 44. To micro adjust the support body 50 along the horizontal axis B, the fastener 42 is partially unthreaded from the block 44. The knob 45 is then turned, which rotates the threaded shaft 46. In turn, the threaded shaft threads through the block, thereby moving the support body left or right along the horizontal axis B as desired. When the desired windage is set for the support body 50, the fastener is rethreaded into the block to lock the micro adjust mechanism at a fixed location on axis B. This windage adjust mechanism can be substituted with any other conventional windage adjustment system as desired.

Figure 2:
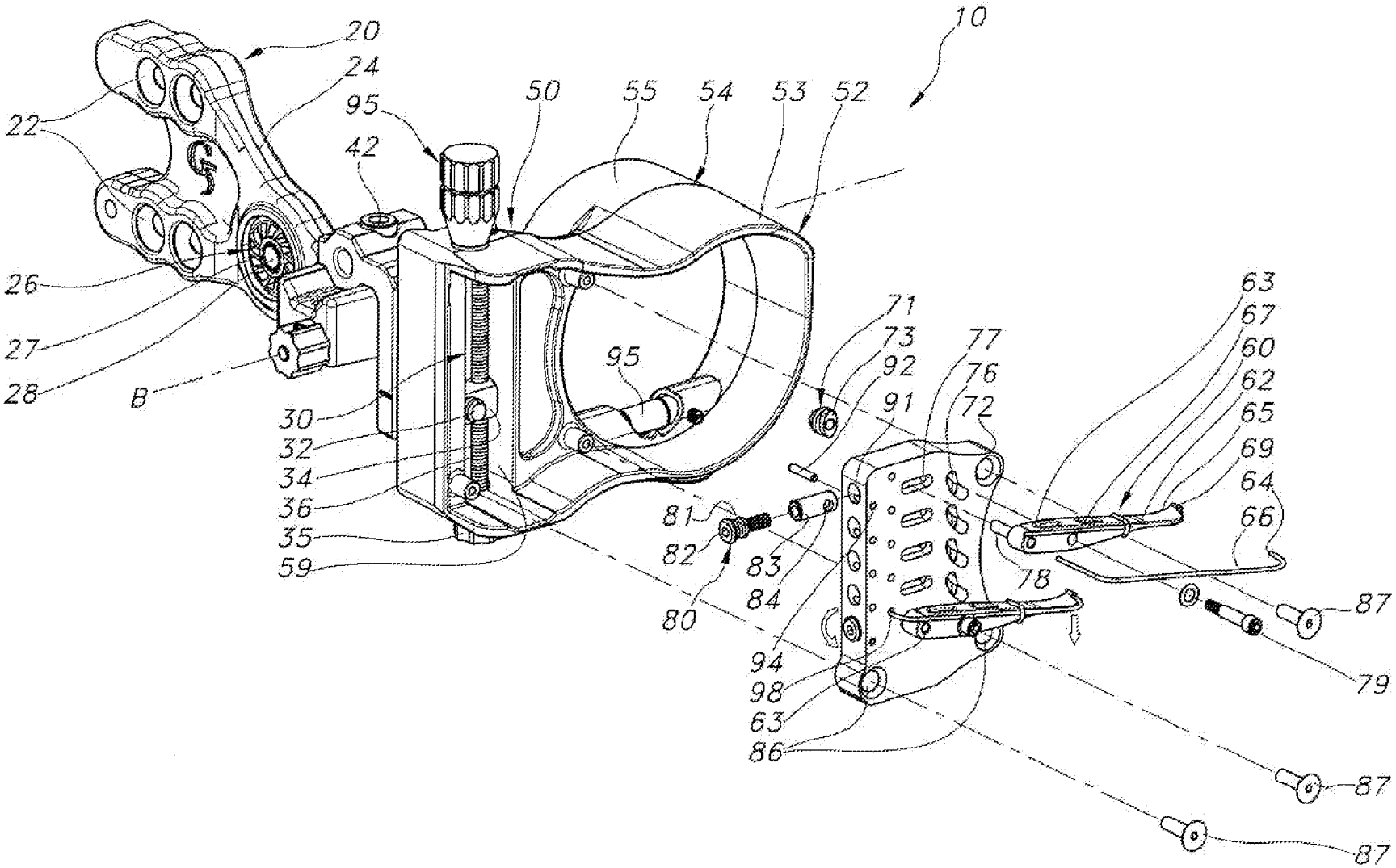
FIG. 2 is a front, partially exploded view of the bow sight.
Figure 3:
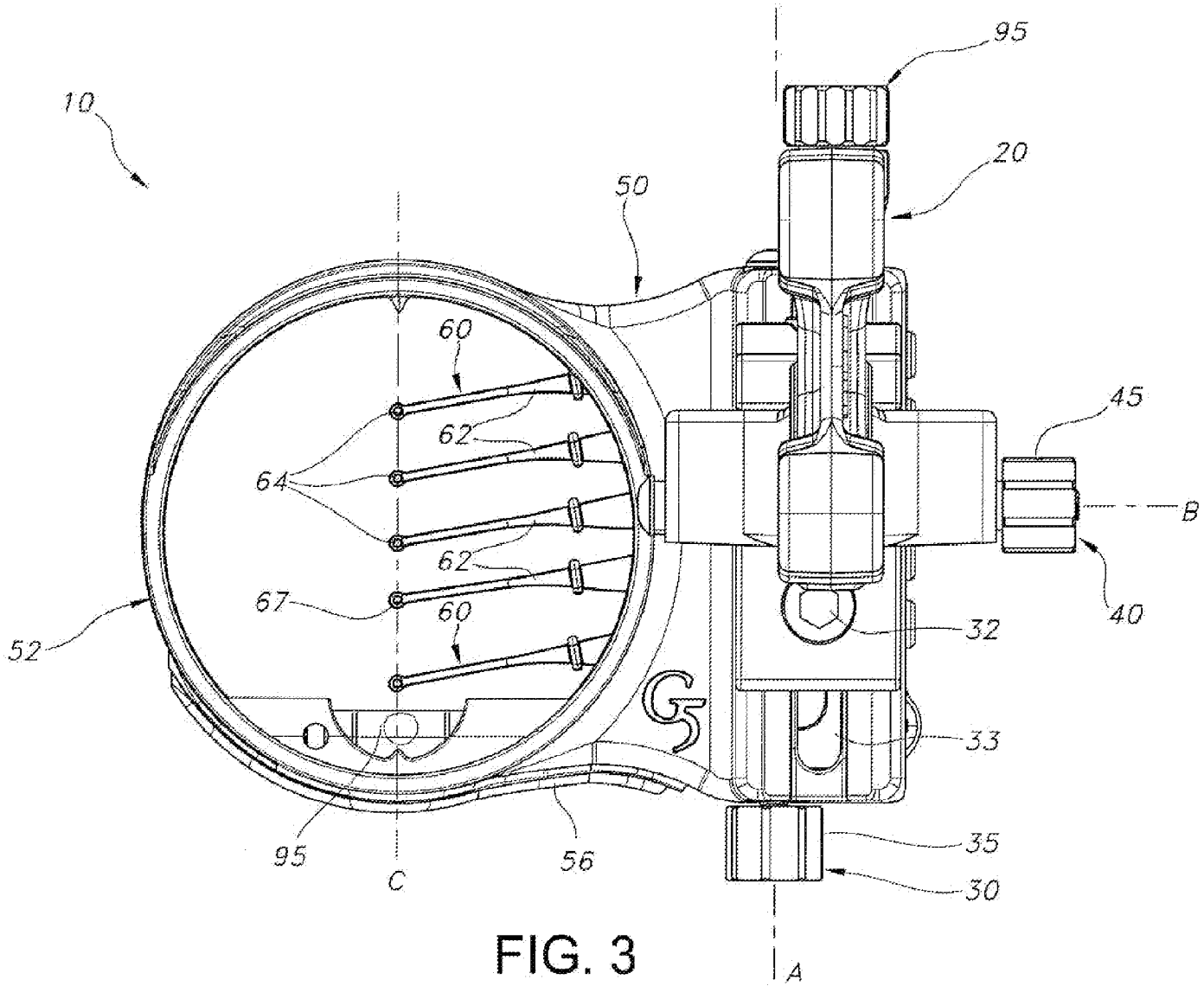
FIG. 3 is a rear view of the bow sight.

As shown in FIGS. 1-3, the bow sight support body 50 is designed to support one or more sight elements 60. The exact number of sight elements can vary, depending on the number of ranges that the bow sight is designed to accommodate. Each sight element 60 generally includes a sight pin 62, a first end 63, which is proximal to the body 50, a second end 65, which is distal from the body 50, and a sight indicia 64 associated with the sight pin 62, usually at the second end 65.

In general, the sight pin 62 can be an elongate member that extends in a substantially horizontal manner from the support body 50. By substantially horizontal, it is meant that the pin extends along a portion of its length between the first end and the second end at an angle deviating from a horizontal plane by about 0 degrees to about 45 degrees, optionally by about 0 degrees to about 25 degrees, and/or further optionally by about 0 degrees to about 15 degrees. In addition, when a sight element is translated by the adjustment mechanism described below from a first angle to a second angle in an adjustment mode, as long as those angles remain within the ranges above, the sight element remains substantially horizontal. Further, although referred to as a "pin", the sight pin itself can be of any cross section, for example, circular, rectangular, triangular, elliptical and the like, and can be of variable cross sections along its length.

The second end 65 of the sight element can include a sight indicia 64. This sight indicia can be any point or indicia of any type that is visually placed in line with a target for assisting in the proper aiming of the bow. Sight indicia can be of any shape, for example, circular, diamond, square, and other geometrical shapes. Moreover, the sight indicia can be formed as colored dots, the end of a light gathering filament, or simply the end of the sight pin. As shown, however, the sight indicia 64 can be formed by the ends of the fiber optic filament 66, which collect light along its length, with the collected light exiting the end of the filament. The length of the fiber optic can be secured to in a conventional manner to the sight element 60. The end of the fiber optic filament 66 forming the sight indicia can be located in a hole 69 defined in the second end 65 of the element. Alternatively, the hole may be absent, and the fiber optic filament can be adhered or crimped or otherwise fastened to the second end 65 as desired. Further alternatively, the fiber optic filament can be replaced entirely with a vile, bulb or tube (not shown) containing a light emitting substance, such as tritium and/or phosphor. The tube can be secured in the hole 69 much like the fiber optic filament to provide a sight indicia for an archer.

Alternatively, the entire sight element can be constructed from light gathering and transmitting material. Accordingly, the second end 65 of the sight element 60 can form the sight indicia 64 without the need for additional fiber optic filaments.

Figure 6:
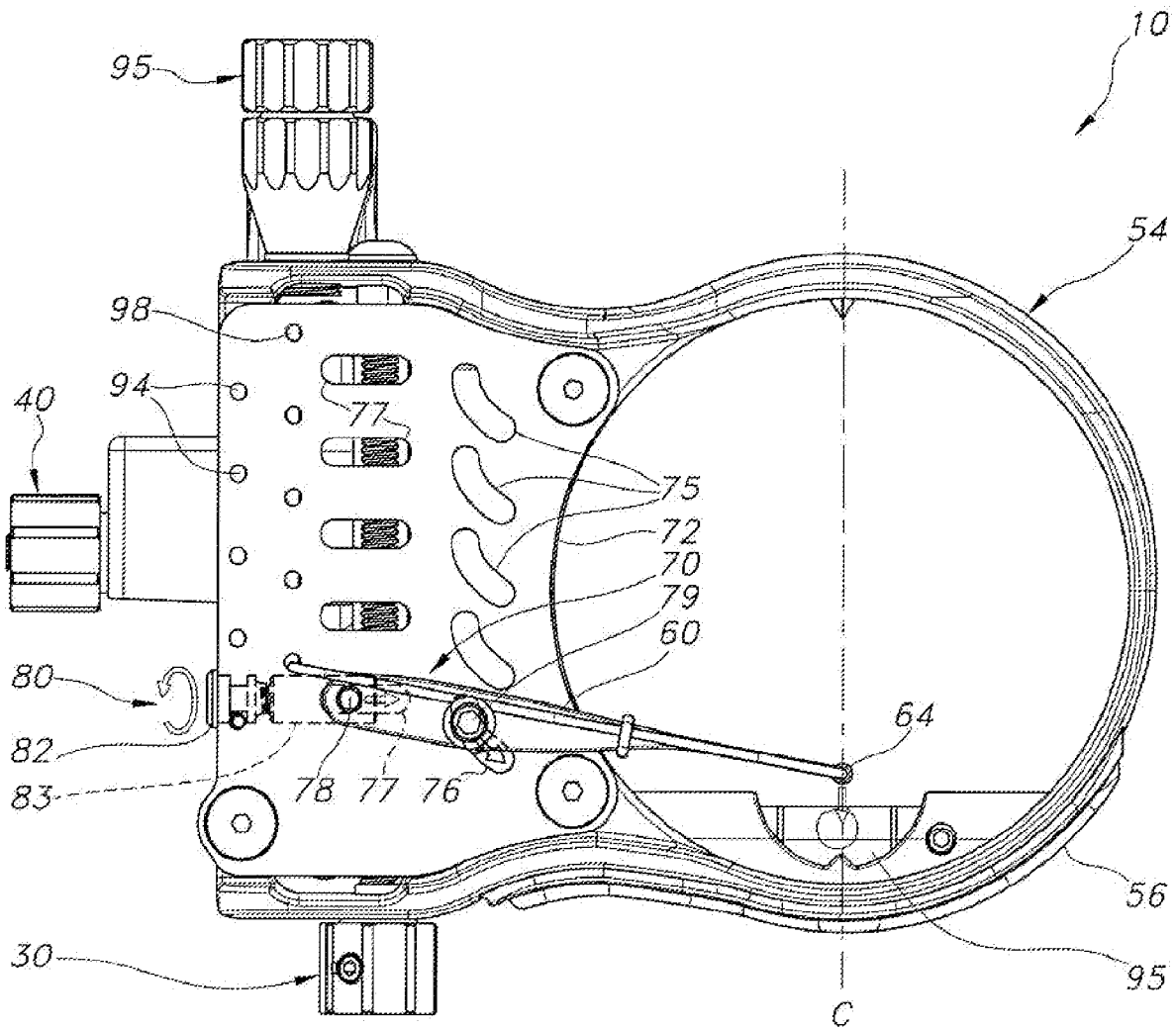
FIG. 6 is a front view of the bow sight showing a sight indicia being adjusted.

Referring to FIGS. 1, 2 and 6, each adjustment mechanism 70 of the bow sight 10 can be associated with a unique sight element 60 to provide adjustment of sight indicia 64 joined with that sight element along the bow sight axis C, also referred to as a third axis. This third axis C can be substantially linear and/or substantially vertical. This orientation can be achieved when the bow, e.g., the elongate axis of the bow, is vertical. The orientation of the third axis C can be measured with an optional level bubble 95 mounted on the bow sight 10, for example, or the sight housing 52, which is joined with the support body 50. When the bubble is centered in this level, this can indicate that the third axis C lies in a substantially vertical plane. As used here in substantially vertical means that the sight axis C lies in a substantially vertical plane, regardless of the angle of the axis C to a horizontal plane.

Each adjustment mechanism 70 can be joined with, and optionally partially formed by, the adjustment mechanism member 72 and the respective unique sight element 60. This adjustment member 72 is generally in the form of a plate, and is interchangeably referred to herein as an adjustment mechanism plate or member 72. The member 72 can include a guide 74, which includes a substantially curvilinear portion formed by a first slot 76 and a substantially linear portion formed by a second slot 77. As used herein, slot can refer to a slot, a channel, a recess and/or a guiding member. The curvilinear portion can be in the form of an arc of a circle, a portion of an ellipse, or any other curvature as desired. The geometric curvature of the slot 76 can be such that it ensures that the associated sight indicia 64 maintains aligned with the third axis C as the sight element is adjusted. Although shown herein as separate slots, the curvilinear slot and linear slot can be a continuous slot having both curvilinear and linear portions, and can still be referred to as first and second slots.

Within the slots 76 and 77 of the guide, corresponding first 78 and second 79 projections associated with the respective sight element 60 are journalled. These projections 78 and 79 can be bosses that are integral with the sight element, pins that are joined with the sight element, fasteners that are secured to the sight element, and/or any other suitable construction that enables the sight element 60 to be guided by the adjustment mechanism 70.

As shown in FIG. 2, however, projection 79 is in the form of a threaded fastener that fits through an aperture 67 defined by the sight element 60 a distance from the distal second end 65. The fastener is journalled and moveable in the slot 76, and a nut 71 is secured to the end of the fastener to partially secure the sight element 60 to the adjustment plate 72. The nut 71 can include a raised portion 73 that engages the slot to prevent rotation of the nut 71 when the fastener is screwed into it. One or more washers can be placed on the fastener to provide the desired spacing as desired.

With reference to FIGS. 1-3, the projection 78 is in the form of a pin that is press fit into an aperture 68 defined by the sight element 60 near the proximal first end 63. The pin is journalled and movable in the slot 77. Incidentally, the pin is rotatable to some degree within the slot 77 as it is moved linearly within the slot toward and away from the third axis C.

Optionally, where the bow sight includes multiple sight elements 60 and corresponding adjustment mechanisms 70, and wherein certain sight indicia are desired to be moved along the third axis C in greater or finer increments than other sight indicia, the design and/or spacing of the slots relative to one another can be varied. In addition, certain sight pins can be associated with slots of one movement increment design, while other sight pins can be associated with slots of another movement increment design. Thus, different sight elements and different sets of sight elements can be moved differently on a given bow sight. As an example, slots 76 and 77 corresponding to the uppermost, middle and bottom sight elements 60 can be identical to one another, but different from the slots 76 and 77 corresponding to the second from the uppermost and lowermost sight elements 60, which slots are identical to one another.

FIGS. 1-6 also illustrate unique actuators 80 associated with each adjustment mechanism 70. Each actuator 80 can include a fastener 82 threaded into a complimentary threaded collar 83. The collar can define an aperture 84 designed to accept the projection 78 coupled to the sight element 60. The fastener 82 and collar 83 can be received and housed in a hole 91 defined by the adjustment mechanism member 72. This recess can be large enough to house as many actuators as desired.

The location of the fastener 82 can be fixed by way of a retaining groove 83 defined on the fastener that mates with an actuator retaining pin 92 positioned in a respective actuator retaining pin aperture 94 defined by the actuator mechanism plate 72. With the groove 81 locked over the pin 92, the fastener 82 can be rotated, but will not move linearly. Thus, due to its threaded engagement with the collar 83, rotation of the fastener 82 imparts linear movement to the collar 83, and the projection 79, and thus the sight element 60. As an alternative, the collar 83 can be removed, and the projection 78 tapped to define an aperture threaded to correspond to the fastener 82; however, in this embodiment, the sight element is able to rotate around the projection pin 78.

The adjustment mechanism member 72 can be removable from the support body 50. For example, as shown in FIG. 2, the member 72 can define apertures 86 which accept member fasteners 87. These member fasteners can be used to fasten the adjustment mechanism member 72 to the support body 50. The fasteners and apertures can be of any conventional variety. Notably, differently outfitted adjustment mechanisms, for example, three sight element, four sight element and five sight element mechanisms can be housed in similarly shaped and configured members 72. With such similar constructions, these different adjustment mechanisms can be modularly coupled to the bow sight support body 50 to provide different bow sights with varying sight element numbers and/or configurations.

Figure 5:
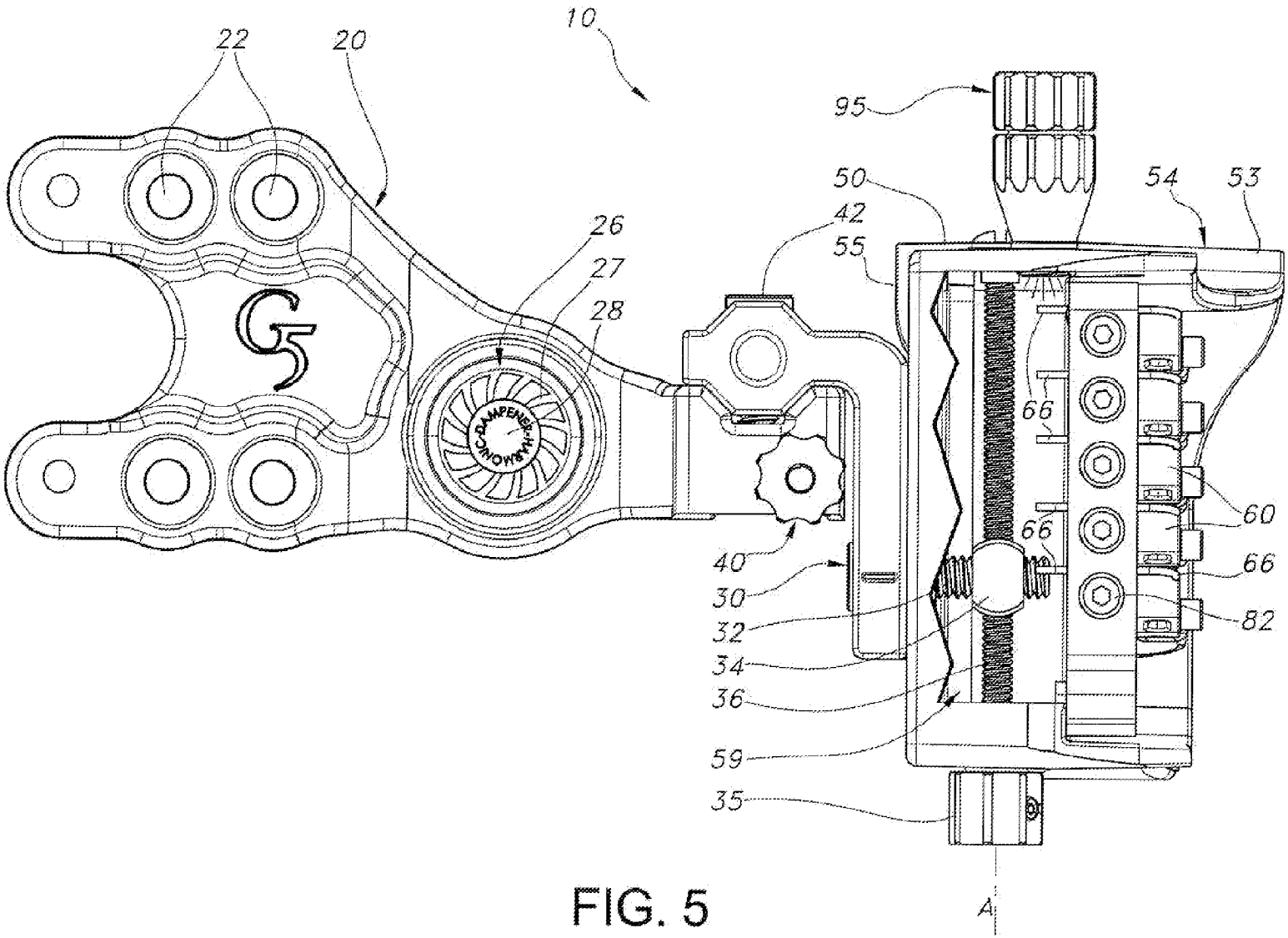
FIG. 5 is a right side view of the bow sight.

The bow sight 10, as shown FIG. 5, can also include an optional light source 95 which provides illumination to the fiber optic filaments 66 in low ambient lighting conditions, and in turn, make,s the sight indicia 64 easier to see in such conditions. The light source 95 can be an LED or comparable light type, and can be mounted to the support body 50 via conventional means. e.g., threaded into a similarly threaded aperture defined by the support body 50. When mounted, the light source 95 is able to illuminate the recess 59 defined by the support body 50. The fiber optic filaments 66 can be positioned through member fiber apertures 98 (FIG. 1) so that a portion of the filaments are exposed to the light illuminating the recess. The illumination in the recess is thus transferred to the sight indicia 64 to illuminate that indicia.

As another option shown in FIGS. 1-5, the sight housing 52 of the bow sight 10 can include a visor 54 on an uppermost portion of the sight housing. The visor can include forward and rearward projecting overhangs 53, 55. The visor can increase the contrast between individual sight indicia and the target, which can make the sight indicia more readily viewable by the archer.

Figure 4:
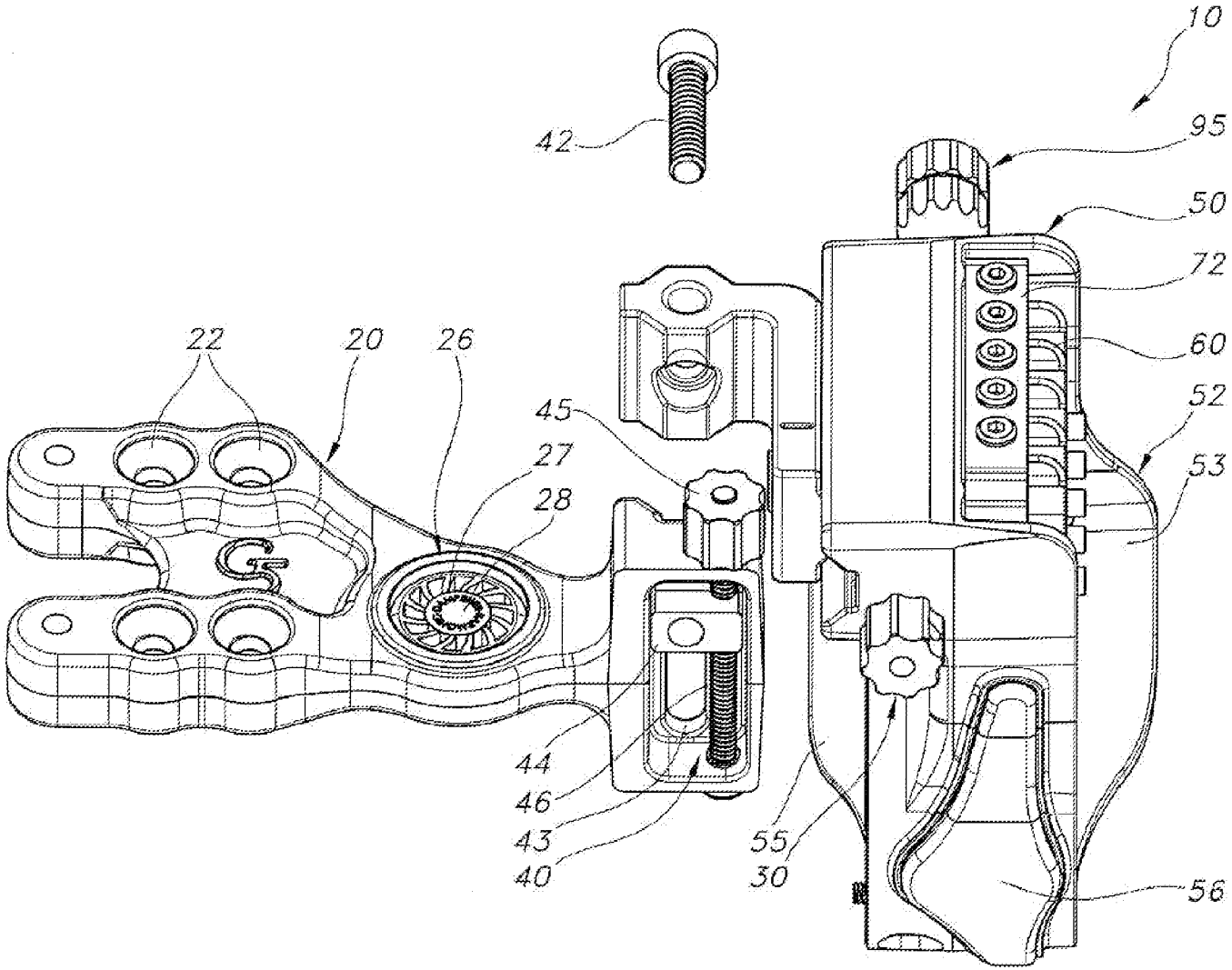
FIG. 4 is a bottom, partially exploded perspective view of the bow sight.

FIGS. 3 and 4 show an optional bumper 56 joined with the lowermost portion of the sight housing 52. This bumper can be constructed from rubber, plastic, synthetic materials or combinations of the foregoing. The bumper can be positioned to minimize or dampen sound if an archer inadvertently bumps an arrow against the bottom of the sight 10.

The bow sight 10 and any of its components can be manufactured from a variety of materials, including, for example, magnesium, magnesium alloy, aluminum, aluminum alloy, titanium, titanium alloy, zinc, zinc alloy, other suitable metals, plastics, ceramics and any combination of the foregoing. In addition, the bow sight components can be manufactured using any one or more of a variety of techniques, such as; Powder Injection Molding (PIM), for example, Metal Injection Molding (MIM) or Ceramic Injection Molding (CIM); die casting; thicksotropic molding; injection molding; or any other suitable manufacturing technique.

II. Operation of the Bow Sight

Operation of the bow sight 10 will now be described in connection with FIGS. 1-6. In general, the bow sight 10 enables an archer to rapidly and confidently tune the bow sight 10 to shoot targets at different ranges, while maintaining alignment of sight indicia with a substantially vertical axis of the bow sight. Where multiple sight elements are included on the bow sight, the sight also enables the archer to adjust the spacing intervals between the sight indicia while maintaining alignment of all the sight indicia with a common vertical axis.

To perform third axis tuning of the bow sight, that is, to move the sight indicia along the axis C, an archer must initiate the actuator 80 by rotating the adjustment fastener 820 clockwise or counterclockwise, depending on whether the archer wants, to adjust the associated sight indicia 64 up or down, respectively, along the third axis C. Because the archer need only perform rotation of the screw, this is considered a type of single adjustment that operates the bow sight. Indeed, with this single adjustment, an archer can perform adjustment of the sight indicia without separately having to modify a secondary locking system. Different types of actuators are suitable for use with the bow sight, e.g., push-pull actuators, lever actuators, cam actuators. Operation of such actuators by the archer can be considered single adjustments as well.

With reference to FIG. 6, turning the fastener 82 clockwise threads the collar 33 off the screw, thus linearly moving the collar away from the screw. The projection 78, coupled to the sight element 60 is guided by and moves within the linear slot 77 toward the fastener 82. As it does, the sight element 60 is moved with the projection, with the sight pin 62 slightly rotating about the projection 78.

As the sight element 60 moves, the projection 79 also is guided by and moves within the curvilinear slot 76. With the slots constraining and guiding movement of the projections and subsequently the movement and rotation of the sight element 60, the sight indicia 64 can move along and remain aligned with the third axis C. The adjustment mechanism 70 can move the sight indicia 64 along the third axis C while simultaneously rotating the sight element 60 about the sight indicia 64. The adjustment mechanism 70 can rotate and move the sight element 60 as it simultaneously moves the sight indicia 64 along the third axis C. In general, the adjustment mechanism can move the sight indicia 64 from a first location on the axis to another location on the axis, Where there are multiple sight elements 60 associated with the bow sight 10, each adjustment mechanism 70 unique to the respective sight elements 60, can be adjusted to move the respective sight indicia 64 along a common third axis C and modify the spacing intervals between the indicia 64 as desired. This adjustment can be performed via the operation discussed above.

Where the bow sight includes a bubble level 95, this level can be used to perform a variety of tasks. For example, the level 95 can be used by the archer to confirm that the third axis C is being held substantially vertically, and thus that the bow itself is also being held substantially vertically. This can confirm for the archer that arrows shot from the bow will have the desired trajectory.

Where the bow sight includes a light source (FIG. 6), an archer can activate the light source when ambient light diminishes to a point that the sight indicia 64 are difficult to see. When activated, the light source 95 illuminates the recess 59 and any fiber optic filaments 66 therein. In turn, illumination in the recess is thus transferred to the fiber optic filaments 66 and to the sight indicia 64 to illuminate that indicia.

III. First Alternative Embodiment

In another embodiment, the adjustment mechanism can be modified Specifically, the position of the bow sight adjustment mechanism slots and projections can be reversed, for example, the slots can be defined by the sight elements and the projections can be included on the bow sight body or adjustment member, or any combination thereof. Further alternatively, the adjustment mechanism can be modified so that a sight element defines a slot and includes a projection, and the adjustments mechanism defines a corresponding projection and a corresponding slot.

Figure 7:
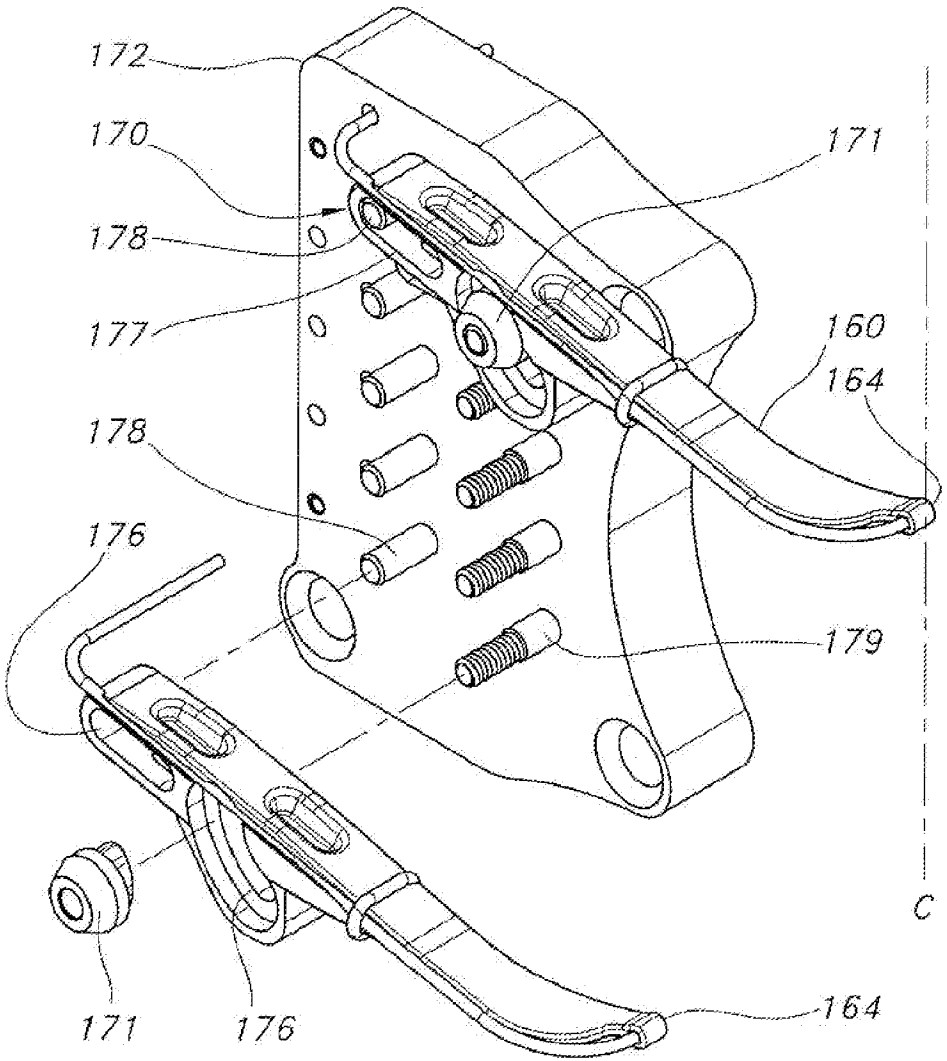
FIG. 7 a first alternative embodiment of the bow sight.

An example of a first alternative embodiment is shown in FIG. 7. There, the adjustment mechanism 170 includes a projection 179, which is movably received in the curvilinear slot 176 defined by the sight element. The projection 179 may be threaded to receive a fastening nut 171 similar to that described in the embodiment above. The adjustment mechanism 170 can also include another projection 178 which is movably received in the linear slot 177 defined by the sight element 160. Although not shown, the projection can be threaded to receive a nut, similar to projection 179, as desired. This embodiment can be outfitted with an actuator much like that described in the embodiment above, except that the actuator optionally can be housed directly in the sight element 160 as desired. Alternatively, other types of compatible actuators can also be associated with the adjustments member 172.

This embodiment also can be operated in a manner similar to that described in connection with the embodiment above, by moving the sight element 160 so that the sight indicia 164 moves along and in alignment with the third axis C. The adjustment mechanism 170 can move the sight indicia 164 along the third axis C while simultaneously rotating the sight element 160 about the sight indicia 164. The adjustment mechanism 170 can rotate and move the sight element 160 as it simultaneously moves the sight indicia 164 along the third axis C.

IV. Second Alternative Embodiment

In a further embodiment, the adjustment mechanism can be modified in a different manner. Specifically, the respective linear and curvilinear slots can be reversed, for example, the linear slots can be near the sight indicia, and the curvilinear slots near the first end of the sight element.

Figure 8:
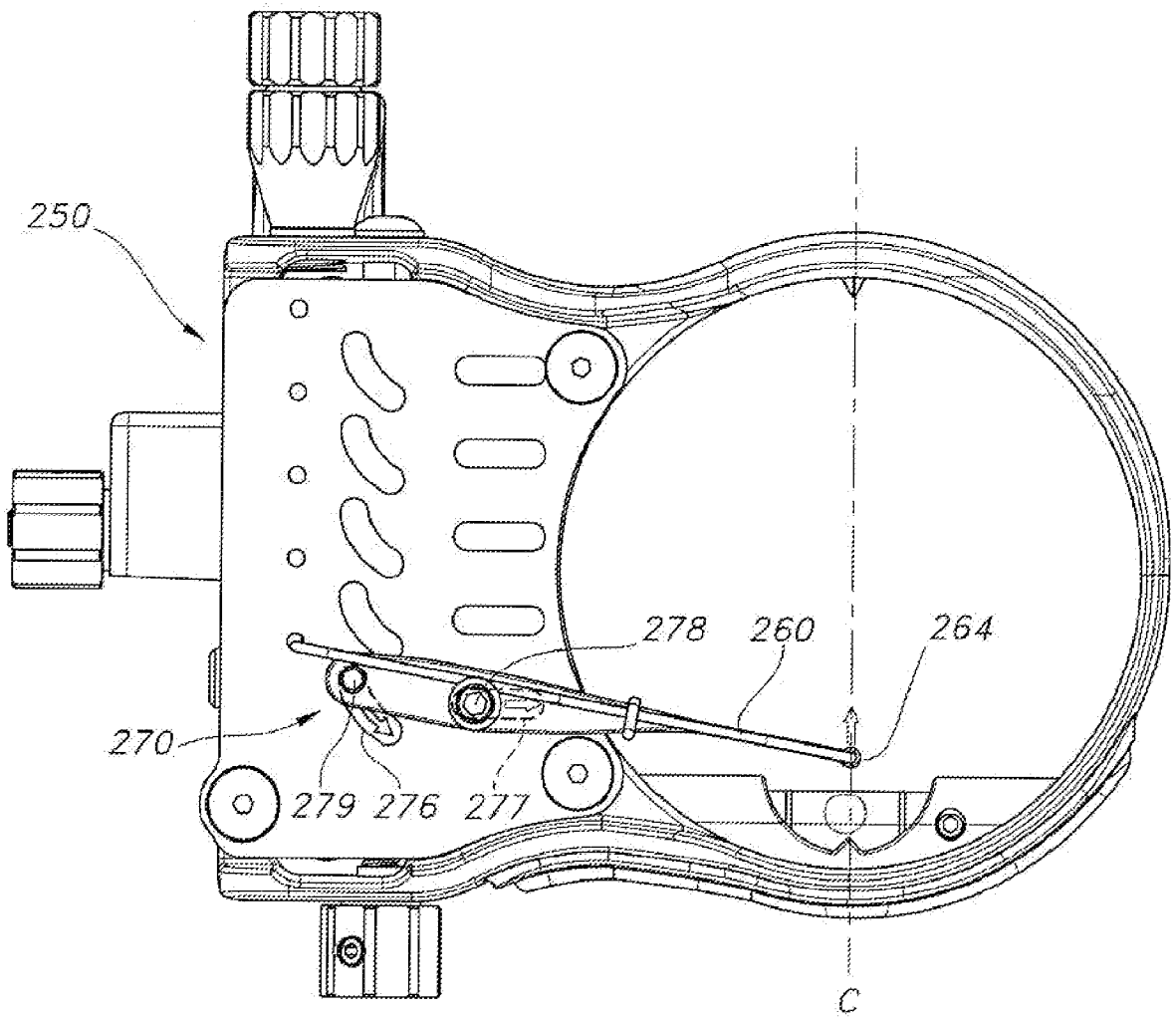
FIG. 8 is a second alternative embodiment of the bow sight.

An example of such an embodiment is shown in FIG. 8. There, the alternative adjustment mechanism 270 includes a curvilinear slot 276 and a linear slot 277, which are in opposite locations relative to the embodiment described above, that is, the curvilinear slot is distal from the sight indicia 264, whereas the linear slot 277 is proximal to the sight indicia 264. The sight element 260 includes projection 279, which is movably received in the curvilinear slot 276, and projection 278, which is movably received in the linear slot 277. Again, as with all embodiments, the projections can be of any suitable form, such as pins, fasteners, and/or projections integral with the sight element that extend from the sight element a distance sufficient to be guided by the slots.

The adjustment mechanism 270 can include the actuator described in connection with the embodiment described above, except modified to move the projection 279 within the slot 276. Alternatively, the actuator for the mechanism 270 can be like that described above, but modified to move projection 278 in slot 277, or any other compatible actuator adapted to impart movement to the sight element 260.

This embodiment also can be operated in a manner similar to that described in connection with the embodiment above, by moving the sight element 260 so that the sight indicia 264 moves along and in alignment with the third axis C. The adjustment mechanism 270 can move the sight indicia 264 along the third axis C while simultaneously rotating the sight element 260 about the sight indicia 264. The adjustment mechanism 270 can rotate and move the sight element 260 as it simultaneously moves the sight indicia 264 along the third axis C.

As with this embodiment, and the embodiments above, multiple sight elements can be individually adjusted to move their respective sight indicia along a common substantially vertical linear axis C and modify the spacing intervals between the indicia as desired.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. An archery bow sight comprising:

a substantially horizontal sight element including a first end, a second end, and a sight indicia joined with the second end, the sight indicia being a fixed distance from the first end, the sight indicia aligned with a substantially linear first axis; and an adjustment mechanism including a curvilinear portion, the adjustment mechanism operable in an adjustment mode in which the curvilinear portion moves the sight element so that the sight indicia moves along the substantially linear first axis, wherein the adjustment mode is performed by way of a single adjustment of the adjustment mechanism by a user.

2. The archery bow sight of claim 1 wherein the substantially linear first axis is substantially vertical.

3. The archery bow sight of claim 1 wherein the adjustment mechanism defines at least one of a curvilinear slot and a linear slot.

4. The archery bow sight of claim 3 wherein the sight element includes at least one of a first projection movably positioned in the linear slot and a second projection movably positioned in the curvilinear slot.

5. The archery bow sight of claim 1 wherein the sight element defines at least one of a curvilinear slot and a linear slot.

6. The archery bow sight of claim 5 wherein the adjustment mechanism includes at least one of a first projection movably positioned in the linear slot and a second projection movably positioned in the curvilinear slot.

7. The archery sight of claim 1 comprising:

a mounting bracket;

a support body joined with the mounting bracket and the adjustment mechanism;

a windage adjustment mechanism joined with the support body and adapted to adjust the support body side to side along a second axis; and an elevation adjustment mechanism joined with the support body adapted to adjust the support body upward and downward along a third axis.

8. The archery sight of claim 7 wherein at least one of the sight element, the adjustment mechanism, the mounting bracket, the windage adjustment mechanism, the elevation adjustment mechanism and the support body is constructed from at least one of magnesium and a magnesium alloy.

9. An archery bow sight comprising:

a sight element including a sight indicia; and adjustment means for moving at least a portion of the sight element along a curvilinear path and for simultaneously moving the sight indicia from a first location on a substantially linear, substantially vertical axis to a second location on the substantially linear, substantially vertical axis.

10. The archery bow sight of claim 9 comprising a plurality of sight elements and a plurality of adjustment means, each adjustment means unique to a corresponding sight element, wherein the adjustment means is adapted to adjust spacing between adjacent sight indicia along the substantially linear, substantially vertical axis.

11. The archery bow of claim 9 wherein the sight element includes a pivot axis, wherein the adjustment means rotates the sight element around the pivot axis as the adjustment means moves the sight indicia along the vertical axis.

12. An archery bow sight comprising:

a sight element;

a sight indicia joined with the sight element and aligned with a substantially linear axis; and adjustment means for moving the sight indicia along the substantially linear axis and for simultaneously rotating the sight element about the sight indicia.

13. The archery bow sight of claim 12 wherein the adjustment means includes an adjustment mechanism defining at least one of a curvilinear slot and a linear slot, and the sight element including at least one of a first projection and a second projection, the first projection being slidably positioned in the curvilinear slot, the second projection being slidably positioned in the linear slot.

14. The archery bow sight of claim 12 wherein the adjustment means includes an adjustment mechanism including at least one of a first projection and a second projection and the sight element defining at least one of a curvilinear slot and a linear slot, the first projection being slidably positioned in the curvilinear slot, the second projection being slidably positioned in the linear slot.

15. The archery bow sight of claim 12 wherein the substantially linear axis is substantially vertical.

16. The archery bow sight of claim 12 comprising a sight housing including an upper portion, the upper portion including a visor.

17. The archery bow sight of claim 12 comprising a sight housing including a lower portion, the lower portion including a bumper, whereby the bumper reduces noise created by an arrow impacting the sight housing.

18. The archery bow sight of claim 12 comprising a rotatable actuator and a collar, wherein rotation of the actuator imparts linear movement to the collar, wherein the collar is joined with the sight element, wherein the linear movement of the collar translates the sight element.

19. A method for tuning an archery bow sight, which includes a sight element and a sight indicia that is joined with the sight element and aligned with a substantially linear axis, comprising: moving the sight indicia along a substantially linear axis and simultaneously rotating the sight element about the sight indicia.

20. The method of claim 19 comprising rotating an actuator to impart a linear force on an end of the sight element.

21. A method for tuning an archery bow sight comprising: actuating an adjustment mechanism to rotate a sight element including a sight indicia; and simultaneously moving the sight indicia from a first location on a substantially linear, substantially vertical axis to a second location on the substantially linear, substantially vertical axis as the sight element rotates.

22. The method of claim 21 wherein the sight element rotates about a pivot axis as the pivot axis moves along a linear path during said actuating step.

* * * * *

UNITED STATES PATENT AND TRADEMARK OFFICE

CERTIFICATE OF CORRECTION

PATENT NO. : 7,278,216 B2
APPLICATION NO. : 11/382847
DATED : October 9, 2007
INVENTOR(S) : Nathaniel E. Grace It is certified that error appears in the above-identified patent and that said Letters Patent is hereby corrected as shown below:

Title Page, Item (73) Assignee:
"G5 Outdoors, L.L.P." should be --G5 Outdoors, L.L.C.--

Signed and Sealed this

Thirteenth Day of May, 2008

JON W. DUDAS
*Director of the United States Patent and Trademark Office*